US006732850B1

(12) United States Patent
Spatafora

(10) Patent No.: US 6,732,850 B1
(45) Date of Patent: May 11, 2004

(54) CIGARETTE HOPPER

(75) Inventor: Mario Spatafora, Bologna (IT)

(73) Assignee: G. D Societa' per Azioni, Via Pomponia (IT)

( * ) Notice: Subject to any disclaimer, the term of this patent is extended or adjusted under 35 U.S.C. 154(b) by 0 days.

(21) Appl. No.: 09/652,375

(22) Filed: Aug. 31, 2000

(30) Foreign Application Priority Data

Sep. 1, 1999 (IT) ..... BO99A0471

(51) Int. Cl.[7] ..... B65B 35/34; B65G 27/00
(52) U.S. Cl. ..... 198/446; 198/533; 53/151
(58) Field of Search ..... 53/148, 151; 221/222, 221/200, 203; 131/282, 283; 366/128, 118; 198/446, 533

(56) References Cited

U.S. PATENT DOCUMENTS

| | | | | |
|---|---|---|---|---|
| 1,926,222 A | | 1/1933 | Arelt | 226/5 |
| 3,579,953 A | * | 5/1971 | Gianese | 53/59 |
| 4,489,534 A | * | 12/1984 | Gomann et al. | 53/151 |
| 4,574,958 A | * | 3/1986 | Manservisi | 209/535 |
| 4,614,263 A | * | 9/1986 | Nagata et al. | 131/282 |
| 5,201,162 A | | 4/1993 | Focke | 53/150 |
| 5,282,527 A | * | 2/1994 | Etani et al. | 198/418.3 |
| 5,350,051 A | * | 9/1994 | Cooper et al. | 198/396 |
| 6,212,860 B1 | * | 4/2001 | Preisner et al. | 53/547 |

FOREIGN PATENT DOCUMENTS

| | | |
|---|---|---|
| DE | 4407305 | 9/1994 |
| EP | 0141322 | 5/1985 |
| FR | 1475759 | 6/1967 |
| FR | 2282370 | 3/1976 |
| FR | 2327923 | 5/1977 |
| GB | 2073155 | 10/1981 |

OTHER PUBLICATIONS

Derwent Abstract FR2327923 dated May 13, 1977.
Derwent Abstract FR2282370 dated Mar. 19, 1976.
Derwent Abstract DE4407305 dated Sep. 8, 1994.
Derwent Abstract EP0141322 dated May 15, 1985.

* cited by examiner

*Primary Examiner*—Rinaldi I. Rada
*Assistant Examiner*—John Paradiso
(74) *Attorney, Agent, or Firm*—Ladas & Parry

(57) ABSTRACT

A hopper for cigarettes, having at least one outlet and a number of agitating members over the outlet; at least some of the agitating members are integral with a bar, which is movable cyclically along an annular path to move all the relative agitating members simultaneously, and parallel to themselves, along respective identical annular trajectories.

13 Claims, 4 Drawing Sheets

CIGARETTE HOPPER

The present invention relates to a cigarette hopper.

BACKGROUND OF THE INVENTION

U.S. Pat. No. 5,201,162-A1 and FR-2,282,370-A1 disclose known cigarette hoppers, each of which comprises a top chamber housing an orderly mass of equioriented cigarettes and terminating at the bottom with a number of outlets, each of which comprises a group of side by side channels defined by a number of substantially vertical walls and having respective inlets communicating with the top chamber. At each outlet, the hopper has an agitating device comprising a number of substantially cylindrical agitating members parallel to the cigarettes in the hopper, and which, in use, oscillate about respective axes. More specifically, the agitating members are mounted in twos close to and on either side of the inlets of respective channels.

In particular, the agitating cylindrical members disclosed in U.S. Pat. No. 5,201,162-A1 are rotary coupled to a fixed frame and are all synchronously oscillated about respective axes by an actuating device; whereas the agitating members disclosed in FR-2,282,370-A1 are also rotary coupled to a fixed frame, but form two groups, in which the agitating cylindrical members of each group are all synchronously oscillated about respective axes by a respective actuating device, and the agitating cylindrical members of each group are oscillated in opposition of phase in relation to the agitating cylindrical members of the other group.

FR-2,327,923-A1 discloses a known cigarette hopper, which comprises a top chamber housing an orderly mass of equioriented cigarettes and a number of bottom outlets each having a respective group of side by side channels defined by a number of substantially vertical walls and having respective inlets communicating with, the top chamber. At each outlet, the hopper has an agitating device comprising a number of agitating members which are parallel to the cigarettes in the hopper and move, in use, back and forth along a straight path. In particular, the agitating members are integral with a common bar, which is moved moves back and forth along a straight path by an actuating device.

Hoppers of the above type have only been found to perform satisfactorily at relatively low speeds, and fail to ensure constant, continuous supply of cigarettes to the channels at the operating speeds of modern packaging machines capable of producing around 15 packets a second.

SUMMARY OF THE INVENTION

It is an object of the present invention to provide a cigarette hopper designed to eliminate the forementioned drawbacks, and which is also straightforward and cheap to produce.

According to the present invention, there is provided a hopper for cigarettes as recited in claim 1.

BRIEF DESCRIPTION OF THE DRAWINGS

The invention will now be described by way of examples with reference to the accompanying drawings, in which.

DETAILED DESCRIPTION OF THE INVENTION

Figure 1:
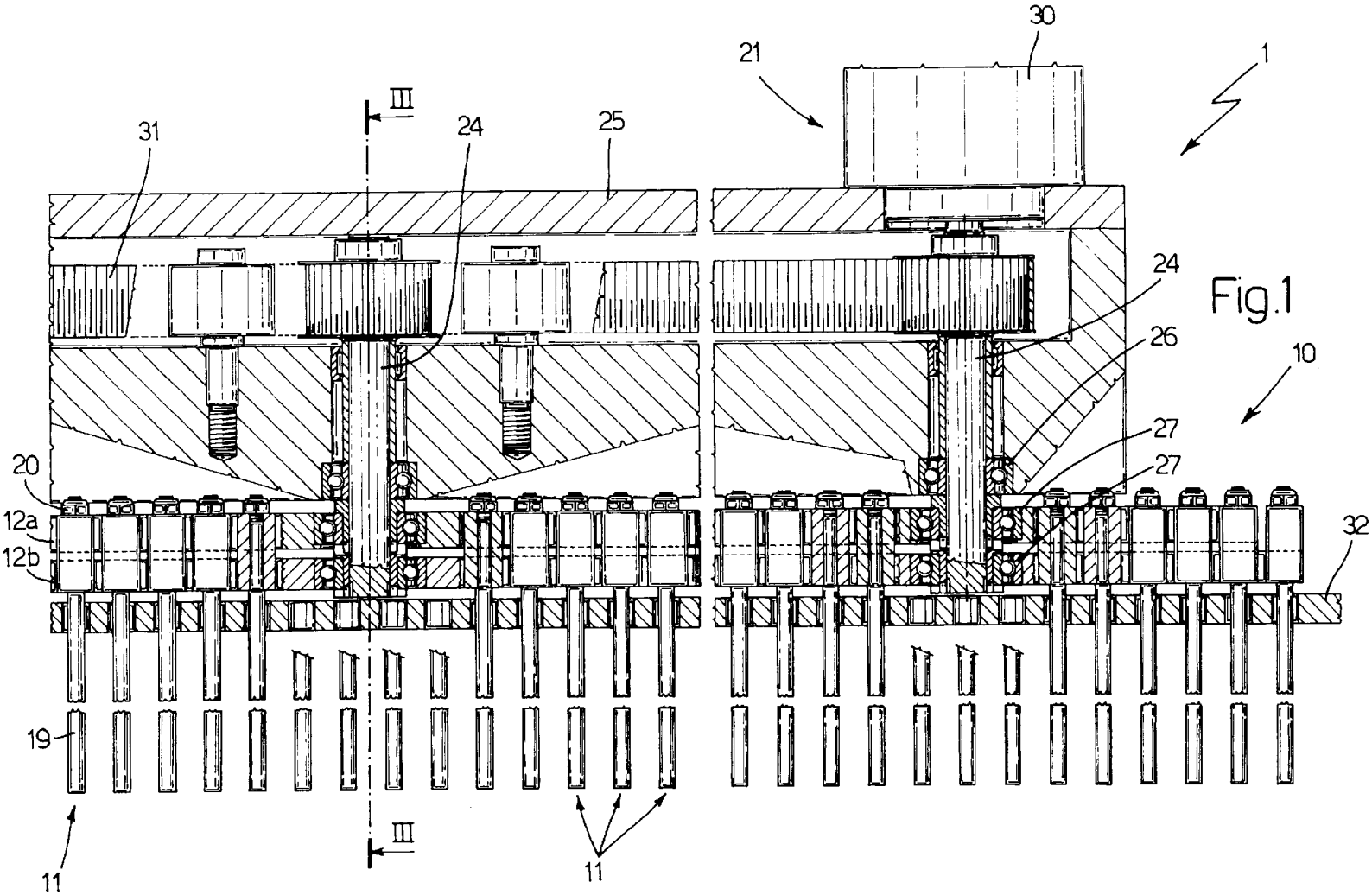
FIG. 1 shows a partial sectioned plan view of a preferred embodiment of the hopper according to the present invention.
Figure 2:
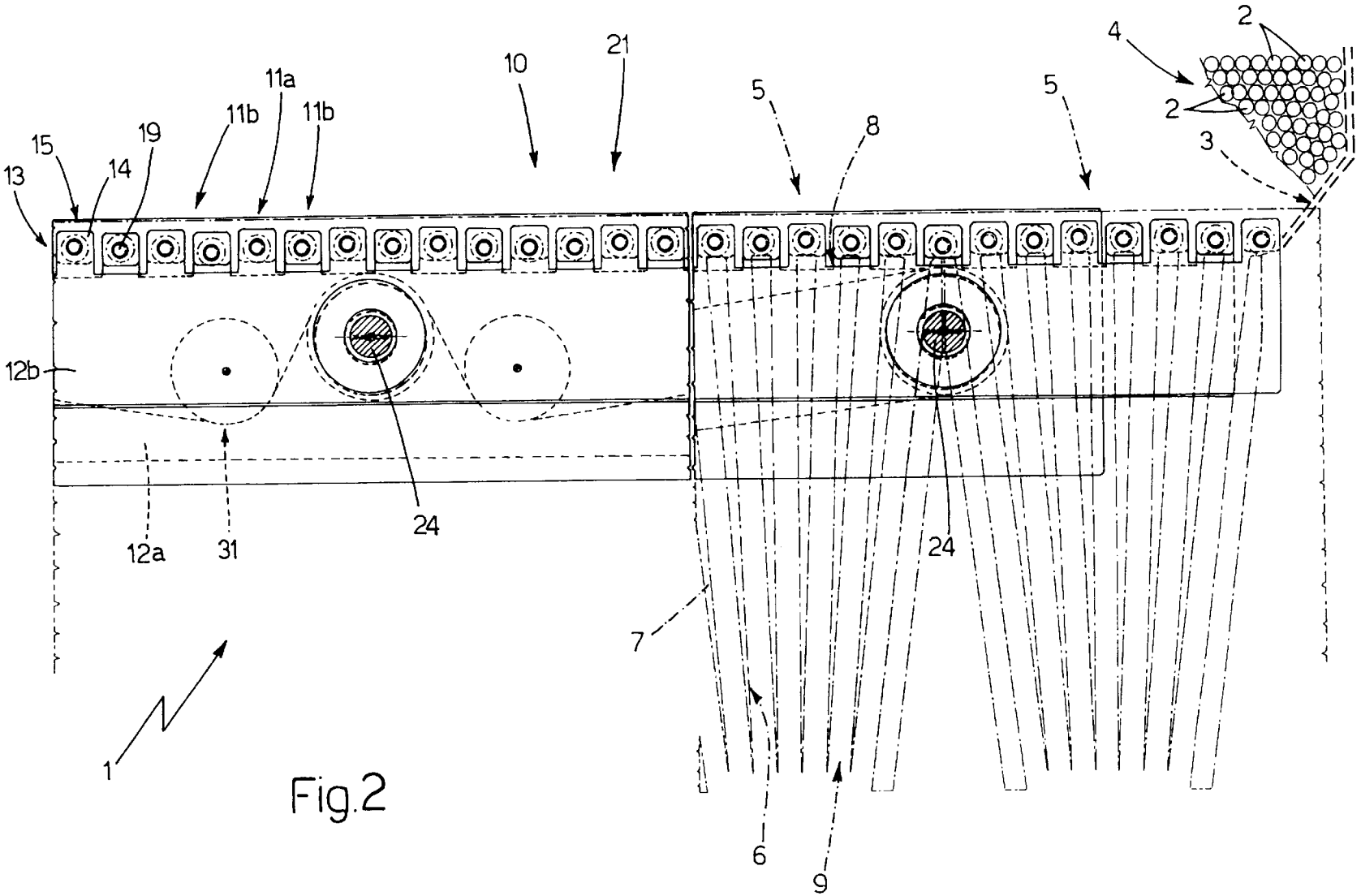
FIG. 2 shows a front view, with parts removed for clarity, of the FIG. 1 hopper.

Number 1 in FIGS. 1 and 2 indicates as a whole a hopper for cigarettes 2 (FIG. 2) positioned with their respective axes perpendicular to the FIG. 2 plane and lying in the FIG. 1 plane. Hopper 1 comprises a known top chamber 3 (shown schematically in FIG. 2) for housing an orderly mass 4 (shown partly in FIG. 2) of equioriented cigarettes 2 and terminating at the bottom with a number of outlets 5, only two of which are shown schematically in FIG. 2. Each outlet 5 comprises a group of side by side channels 6 defined by a number of substantially vertical walls 7 and having respective top inlets 8 communicating with chamber 3, and respective bottom outlets 9 communicating with a known device (not shown) for forming groups of cigarettes 2.

In actual use, cigarettes 2 are fed into a known top opening (not shown) of chamber 3, and fall by force of gravity along chamber 3 and gradually into respective channels 6 of outlets 5 to the known device (not shown) for forming groups of cigarettes 2.

To ensure constant, continuous supply of cigarettes 2 to channel 6, hopper 1 has an agitating device 10 comprising a number of substantially cylindrical agitating members 11 parallel to cigarettes 2 in chamber 3 and over outlets 5. More specifically, agitating members 11 are mounted close to and over inlets 8 of channels 6, so that each channel 6 has two agitating members 11 on either side of inlet 8.

Agitating device 10 comprises two vertical, parallel bars 12*a*, 12*b* perpendicular to agitating members 11, and each bar supports, in a fixed position, a respective number of agitating members 11, so that the agitating members 11 a carried by one bar 12*a* alternate with the agitating members 11*b* carried by the other bar 12*b*. The above arrangement is made possible by each bar comprising a "comb-shaped" top portion 13 having a number of teeth 14 supporting respective agitating members 11 and alternating with respective teeth 14 of the other bar.

Figure 3:
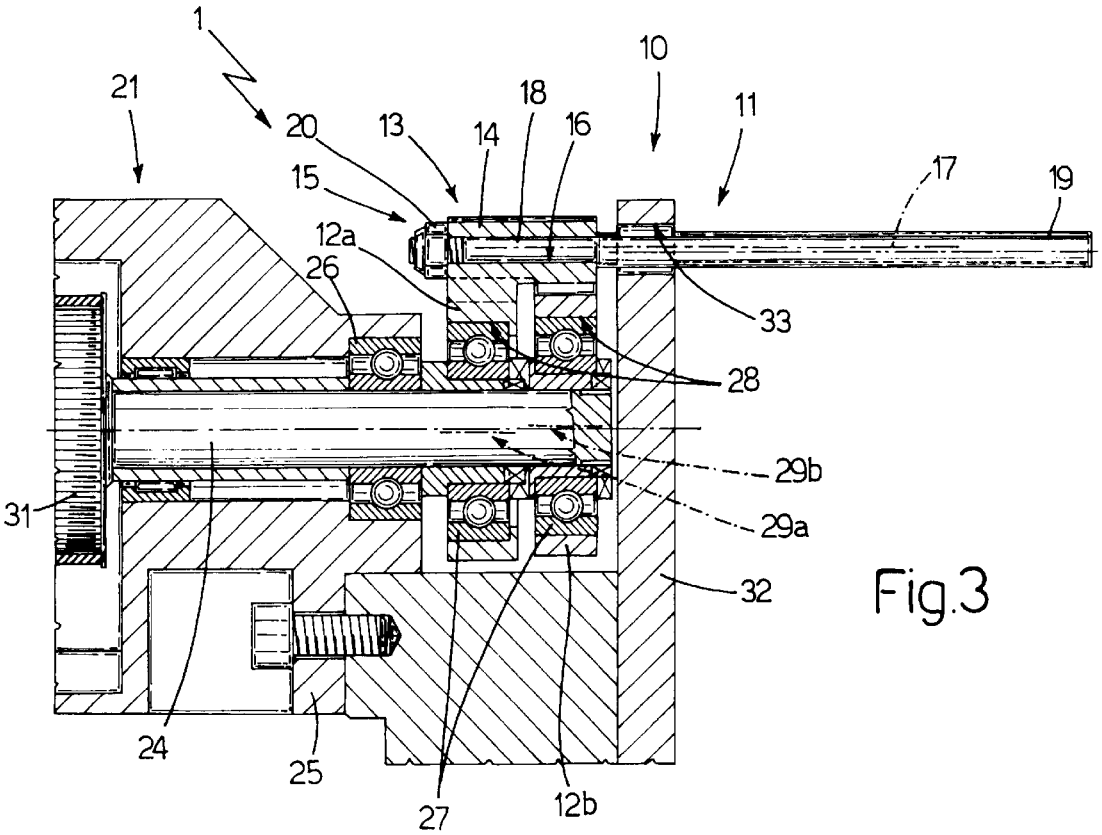
FIG. 3 shows a section, with parts removed for clarity, along line III—III of the FIG. 1 hopper.
Figure 4:
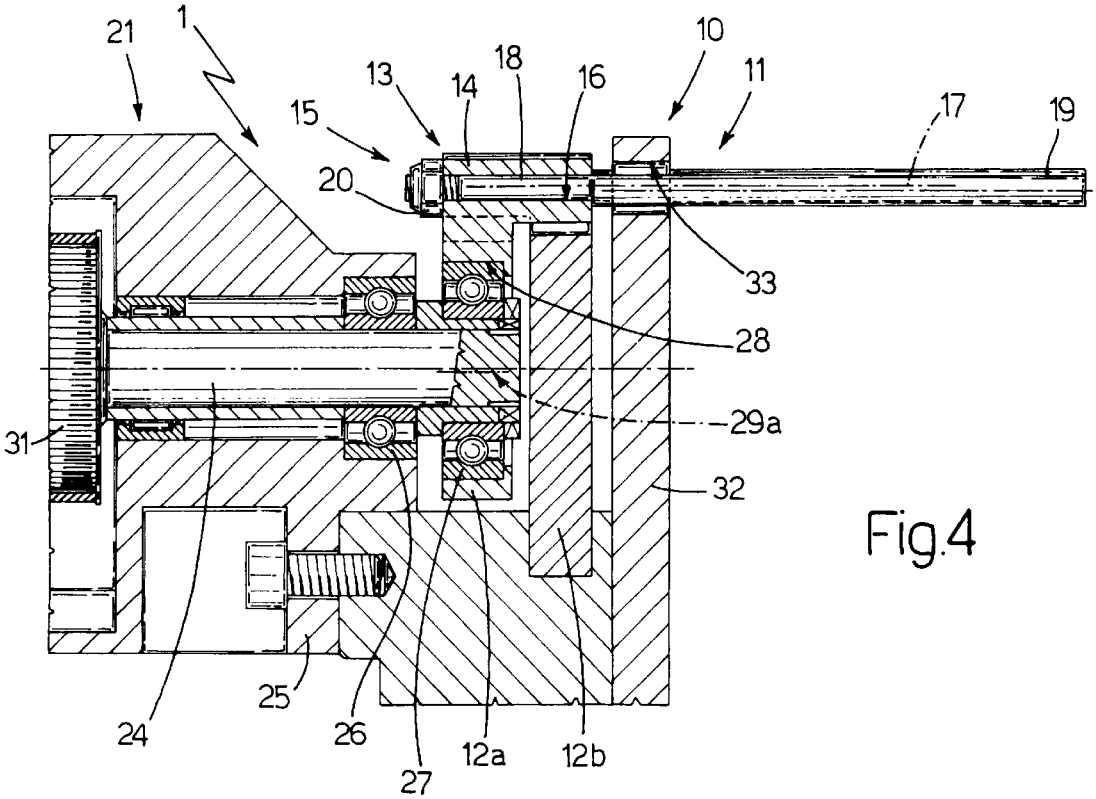
FIG. 4 shows a section, with parts removed for clarity, of a further embodiment of the hopper according to the present invention.
Figure 5A:
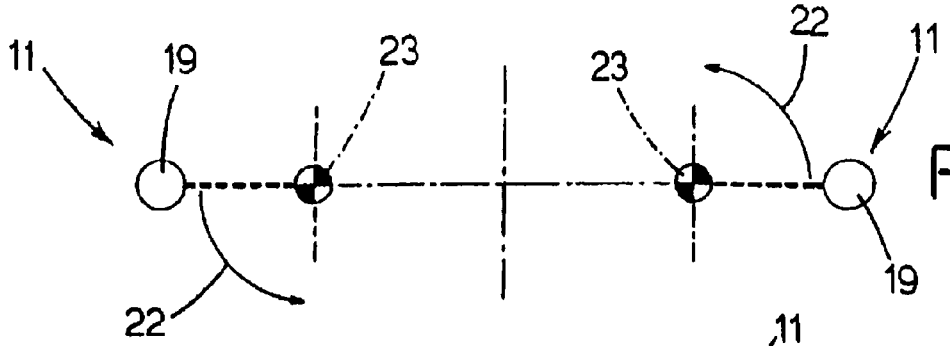
FIG. 5 shows the movement performed, in use, by certain parts of the FIG. 1 hopper.
Figure 5B:
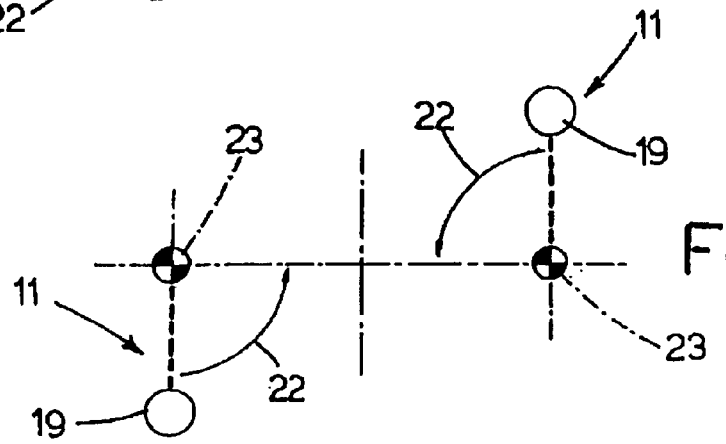
Figure 5C:
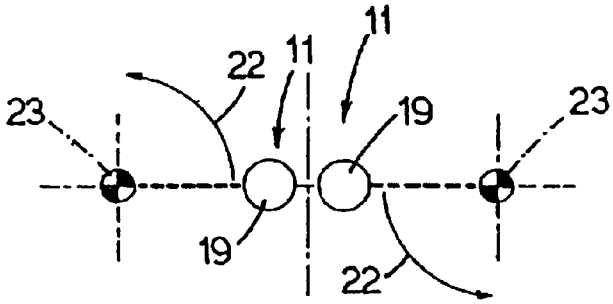
Figure 5D:
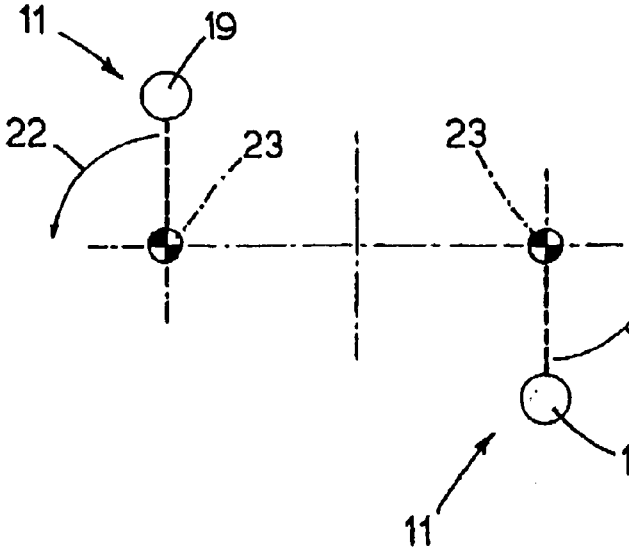

As shown in FIGS. 3 and 4, each tooth 14 has an end portion 15 having a respective central through hole 16 coaxial with an axis 17 and engaged by a respective end pin 18 of a respective agitating member 11, which, in addition to respective pin 18, also comprises a cylindrical rod 19 parallel to but eccentric with respect to axis 17. Teeth 14 are equally spaced along its relative bar and agitating members 11 are fixed—means of respective nuts 20 fitted to respective pins 18—to respective teeth 14 in different angular positions, so that the eccentricity of rods 19 with respect to respective axes 17 is oriented differently from one rod 19 to another.

Agitating device 10 also comprises an actuating-g device 21 for moving each bar 12*a*, 12*b* cyclically along a respective annular path, and so moving all the relative agitating members 11 simultaneously, and parallel to themselves, along respective identical annular trajectories 22 (FIG. 5). More specifically, trajectories 22 are circular and extend about respective horizontal axes 23 parallel to respective axes 17.

As shown in FIG. 3, actuating device 21 comprises a number of shafts 24 (only two shown in FIGS. 1 and 2) which are fitted to the frame 25 of hopper 1 via the interposition of respective bearings 26, and support bars 12*a*, 12*b* via the interposition of respective bearings 27 engaging respective circular holes 28 in bars 12*a*, 12*b* and having respective given eccentricities 29*a*, 29*b*. As shown in FIG. 3, the eccentricity 29*a* of bar 12*a* differs from the eccentricity 29*b* of bar 12*b* so as to impart different movements to bars 12*a*, 12*b*. More specifically, eccentricities 29*a*, 29*b* are equal in value but of different (preferably opposite) radial orientations, so that bars 12*a*, 12*b* move along substantially identical paths with different phases.

As shown in FIGS. 1 and 2, one of shafts 24 is a drive shaft, and is angularly integral with a motor 30 for rotating drive shaft 24 continuously at constant angular speed (normally proportional to the operating speed of the machine interacting with hopper 1). The other shafts 24 are driven shafts made angularly integral with drive shaft 24 by means of a known belt transmission 31.

In the FIG. 5 example, two adjacent agitating members 11 travel along identical trajectories 22 with opposite phases; which movement enables agitating members 11 to so stress mass 4 of cigarettes 2 as to prevent the formation of and/or remove any bridge formations of cigarettes 2 (preventing and/or hindering the downward travel of cigarettes 2 along chamber 3) and so ensure constant, continuous supply of cigarettes 2 to channels 6, even at relatively high operating speeds.

In an alternative embodiment shown in FIG. 4, actuating device 21 only moves bar 12*a*, the other bar 12*b* being fitted in a fixed position to frame 25 of hopper 1.

In an alternative embodiment not shown, agitating device 10 comprises one movable bar to which agitating members 11 are all connected integrally.

In the embodiment shown in the accompanying drawings, a partition 32 is interposed between bars 12*a*, 12*b* and chamber 3, and has a number of through holes 33 for rods 19 of agitating members 11. The diameters of holes 33 are larger than the outside diameters of rods 19 to enable rods 19 to be moved, in use, along trajectories 22 by actuating device 21.

What is claimed is:

1. A hopper for cigarettes comprising an outlet, a plurality of agitating members located above said outlet, first and second bars, some of said agitating members being integrally secured to said first bar and the remainder of said agitating members being integrally secured to said second bar, the agitating members secured to the first and second bars alternating with one another, and actuating means for displacing at least one of said bars along an annular path of 360° around a stationary axis continuously in one direction, said agitating members which are secured to said at least one bar simultaneously traveling therewith parallel to one another along respective corresponding annular paths of 360° continuously in said one direction.

2. A hopper as claimed in claim 1, wherein each said bar comprises a number of holes equally spaced along the bar; each said agitating member comprising a pin engaging and fixed through a respective said hole, and a substantially cylindrical rod integral with and parallel to the respective said pin and eccentric with respect to the respective pin; and said pins being so fixed to the respective said bar that said eccentricities of said rods are oriented differently from one rod to another.

3. A hopper as claimed in claim 1, wherein said path is a circular path; said actuating means comprising at least two shafts having eccentric portions respectively engaging said bars in rotary manner.

4. A hopper as claimed in claim 1, wherein said annular paths are identical.

5. A hopper as claimed in claim 1, wherein said first and second bars are eccentrically offset around said stationary axis by 180° to revolve out of phase with one another.

6. A hopper as claimed in claim 1, wherein said agitating members are mounted in said bars in eccentric offset positions.

7. A hopper as claimed in claim 1, wherein said actuating means drives said at least one bar via an eccentric around said axis continuously in a circular path, said agitating members traveling with said at least one bar continuously along respective circular paths in the same direction of rotation.

8. A hopper as claimed in claim 1, wherein said actuating means comprises a drive shaft rotatable around said stationary axis, and an eccentric arrangement between said drive shaft and said at least one bar to produce said movement of said at least one bar around said axis as said drive shaft rotates.

9. A hopper as claimed in claim 1, wherein said second bar is fixed.

10. A hopper as claimed in claim 1, wherein said actuating means displaces both said first and second bars along respective said annular paths so that all said agitating members travel along their respective said annular paths.

11. A hopper as claimed in claim 10, wherein said actuating means displaces said first and second bars along their respective annular paths in different angular phases.

12. A hopper as claimed in claim 1, wherein said bars have upper end portions with teeth arranged in comb-like manner, said agitating members being secured to the teeth of the bars, said first bar being positioned in front of said second bar, the agitating members secured to said second bar passing through spaces between the teeth of the first bar.

13. A hopper as claimed in claim 1, wherein said actuating means comprises a shaft driven in rotation around said stationary axis, said at least one of said bars being eccentrically mounted on said shaft to travel around said stationary axis continuously along said annular path of 360° in the same direction.

* * * * *